US005249698A

United States Patent [19]

Cruver et al.

[11] Patent Number: 5,249,698

[45] Date of Patent: Oct. 5, 1993

[54] ABOVE GROUND HAZARDOUS LIQUID STORAGE APPARATUS

[76] Inventors: Philip Cruver, 8309 Ridge St., McLean, Va. 22101; Mark Cruver, 6083 Talavera Ct., Alexandria, Va. 22310; Reginald L. Olson, P.O. Box 60432, Las Vegas, Nev. 89160

[21] Appl. No.: 976,918

[22] Filed: Nov. 18, 1992

Related U.S. Application Data

[63] Continuation-in-part of Ser. No. 892,909, Jun. 3, 1992, which is a continuation of Ser. No. 670,671, Mar. 18, 1991, abandoned, which is a continuation of Ser. No. 590,705, Sep. 28, 1990, Pat. No. 5,033,638.

[51] Int. Cl.[5] ..... B65D 88/76

[52] U.S. Cl. ..... 220/565; 220/445; 220/612; 220/571

[58] Field of Search ..... 220/565, 445, 571, 611, 220/612, 571

[56] References Cited

U.S. PATENT DOCUMENTS 3,851,611 12/1974 Yamamoto ..... 220/445
4,343,413 8/1982 Chatzipetros et al. ..... 220/445
4,651,893 3/1987 Mooney ..... 220/445
4,911,326 3/1990 McGouran Jr. ..... 220/445
5,082,138 1/1992 McGarvey ..... 220/445

*Primary Examiner*—Joseph Man-Fu Moy

[57] ABSTRACT

A fire and heat resistant vault construction is provided for the storage of hazardous or polluting liquids which comprises an inner cylindrical tank for storing such liquids and an outer casing in which the inner cylindrical tank is housed. The outer casing is of two-piece construction and includes a plurality of ribs extending inwardly from the inner surface thereof in engagement with portions of the outer tank wall and defining a plurality of air spaces between the inner wall of the casing and the outer tank wall. The ribs are discontinuous at the bottom of the casing so as to define a channel along the bottom of the casing. Thus, liquid spilled during filling of the tank or liquid leaking from the tank can collect in the channel. The outer casing further includes an indicator device such as a plug of transparent material located in the bottom of the casing, for providing a visual indication that liquid has collected in the channel.

28 Claims, 5 Drawing Sheets

Fig. 5
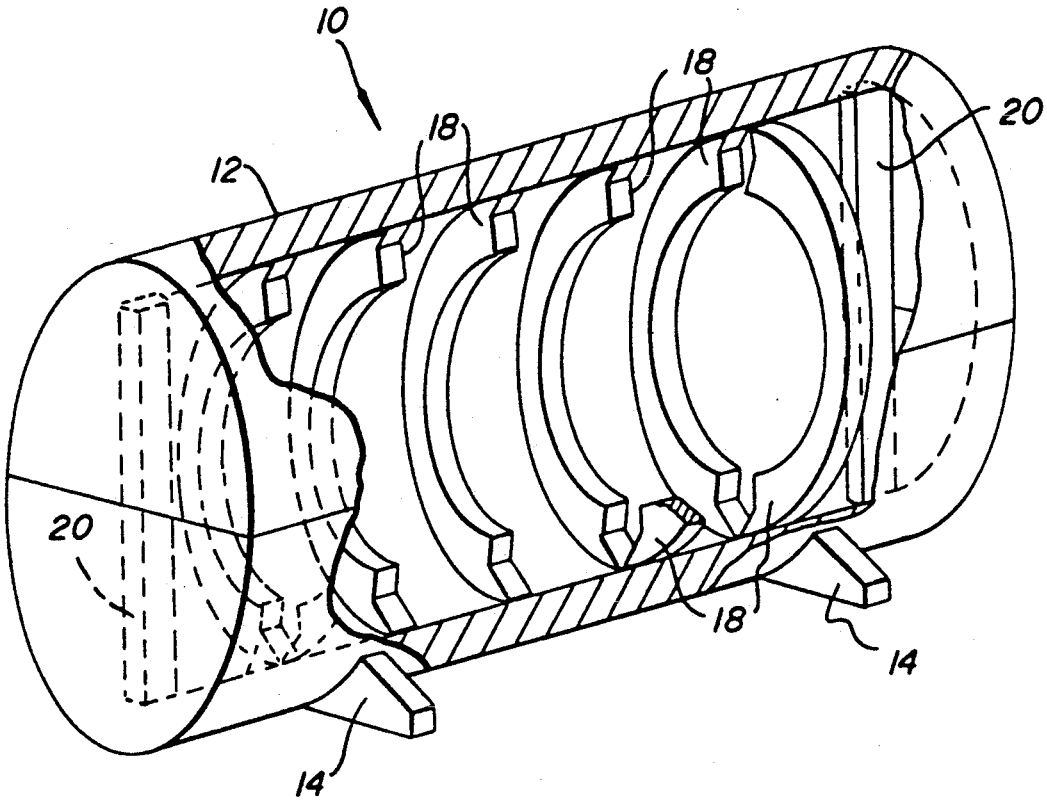
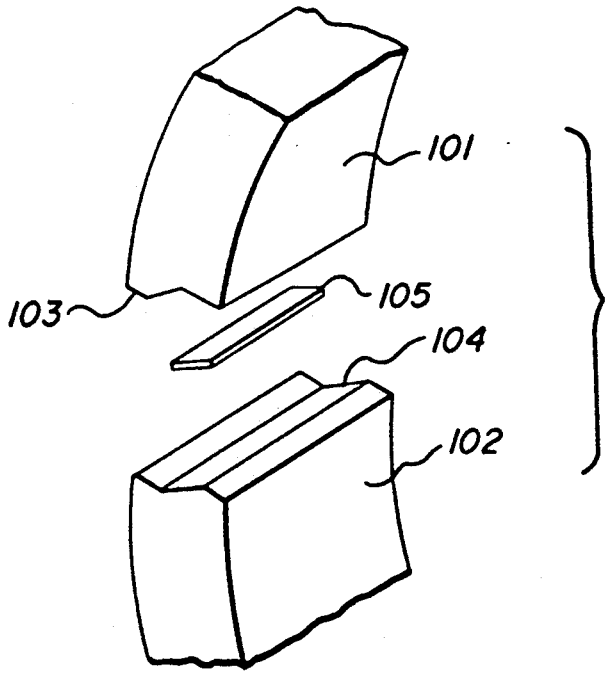
Fig. 6

ABOVE GROUND HAZARDOUS LIQUID STORAGE APPARATUS

CROSS REFERENCE TO RELATED APPLICATIONS

This is a continuation-in-part of U.S. patent application Ser. No. 07/892,909, filed Jun. 3, 1992, which is a continuation of U.S. patent application Ser. No. 07/670,671, filed Mar. 18, 1991 (now abandoned), which is in turn a continuation of U.S. patent application Ser. No. 07/590,705, filed Sep. 28, 1990, now U.S. Pat. No. 5,033,638, the disclosure of which is incorporated by reference herein.

BACKGROUND OF THE INVENTION

1. Field of the Invention

The present invention relates to an improved above ground liquid storage vault apparatus for the storage of hazardous or pollution-causing liquids or liquid wastes which are flammable/combustible, and more particularly, to such a storage vault which is resistant to fire and heat.

2. Description of the Related Technology

Increasing interest in protecting the environment has resulted in heightened concerns about the pollution and other dangers resulting from leakage from underground storage tanks for hazardous liquids. Some of these concerns include the problem of leakage of the liquid into ground water supplies and dangers due to fires or explosions. Many of these storage tanks were placed underground in the 1950's and 1960's as a fire prevention measure in order to reduce the risk of damage from stored flammable liquids such as gasoline. Such tanks are often constructed from bare steel, are not protected from corrosion and have now reached or are nearing the end of their useful lives. It has been estimated that as many as 400,000 of these underground storage tanks are now leaking and that many more will being leaking in the near future.

In an attempt to correct this problem in the United States, the U.S. Environmental Protection Agency (EPA) issued strict regulations at the end of 1988 which mandate certain duties and responsibilities on the part of owners of underground storage tanks including burdensome and expensive corrective action that these owners must take. It will be appreciated that, even apart from the burdens of the EPA regulations, if a leak in a tank is detected, the basic options are limited and burdensome to an owner, e.g., the tank can be drained and abandoned, dug out of the ground and repaired or discarded, or repaired while in the ground, all of which are expensive operations. As the deadline for compliance imposed by the EPA regulations approaches, owners of underground tanks have been considering alternatives to aboveground storage. However, while constructing aboveground storage tanks largely eliminates the need to comply with strict environmental regulations, these regulations are replaced by the vagaries of state and local safety codes. For example, many of the codes require that the inner tank be listed by Underwriter's Laboratory (UL), that secondary containment be provided, and that flammable liquids have a two hour fire wall at 2,000° F. It should be noted that simple aboveground tanks alone are clearly prohibited and that storage "vaults," i.e., tanks within an outer containment, are required. In general, a UL inner tank encased within six inches of concrete will be designated as a vault and will meet most state and local safety codes while being exempted from current underground Federal regulations.

Some recently developed vaulted technology involves the use of a custom fabricated rectangular steel tank encased or entombed within a block of standard concrete. An example of such a vault apparatus is that disclosed in U.S. Pat. No. 4,826,644 (Linquist et al.), wherein an inner tank is entombed within a concrete outer tank using a specialized method.

A further patent of possible interest is U.S. Pat. No. 4,895,272 (DeBenedittis et al.), which relates to a liquid storage system including an external containment vessel which is open on top and an internal storage tank disposed within the external containment vessel so as to define an outer storage space therein. A drainage arrangement provides coupling of liquid from a vent on the internal storage tank to the outer storage space.

However, the need still exists in this industry for an improved aboveground liquid storage vault which provides total secondary containment and is resistant to fire and heat.

SUMMARY OF THE INVENTION

According to the invention, an improved aboveground liquid storage valve construction is provided which overcomes the problems associated with prior art vaults and other storage device and which also affords a number of advantages, particularly with respect to weight reduction and decreased transportation costs, ease of handling, and increased fire protection. The vault construction of the invention also provides effective secondary containment which is obviously important (and in many instances required by law) in storing flammable and/or otherwise hazardous or pollution causing liquids.

In accordance with a preferred embodiment of the invention, a vault construction is provided for the storage of hazardous or polluting liquids, wherein the vault construction comprises: an inner cylindrical tank for storing such liquids; and an outer cement casing in which said inner cylindrical steel tank is housed and which comprises a plurality of ribs extending inwardly from the inner surface of the casing in engagement with portions of the outer tank wall and defining a plurality of air spaces between the inner wall of the casing and the outer tank wall, the ribs being discontinuous at the bottom of the casing so as to define a channel along the bottom of the casing so that liquid leaking from the tank can collect in that channel, and the outer casing further including an indicator means for providing an indication that liquid has collected in said channel.

In one preferred embodiment, the indicator means comprises a visual indicator means. Advantageously, the visual indicator comprises a plug of transparent material located in the bottom of the casing.

According to an important feature of the invention, the casing is a two-piece construction. Preferably, the outer casing comprises upper and lower halves which fit together to form the casing, said halves fit together by means of a fire and heat resistant shiplap joint allowing for concrete to concrete contact. Advantageously, the upper and lower halves are substantially identical so that manufacturing costs are reduced.

According to an advantageous feature of the invention a specialized fire resistant joint may be provided between the two parts of the outer casing. Advantageously, this joint should be able to withstand a two hour fire pool at 2000°.

Advantageously, the wall joint is a multiple seal joint. The multiple seal joint may be made up of an outer seal which is advantageously panel caulk, an intermediate seal made up of a refractory fiber, and an inner seal made up of a petroleum resistant concrete sealant. The refractory fiber intermediate seal may include refractory oxides, in particularly, exceptionally pure refractory oxides which may be bonded with an organic binder. The refractory fibers may be either of the oven cured or pressed types.

Advantageously, the inner seal is a fuel and oil resistant sealant and may be a premium quality extruded non-hydrocarbon sealant suitable for fuel and oil resistant applications. The material should have good structural integrity suitable materials are available from Concrete Sealants, Inc. under the trade name CS-440. Suitable refractory fibers are available from Morgan Thermal Ceramics under the trade names CERAFELT® and FIREMASTER®. The refractory fiber intermediate seal may be a two-inch wide strip of CERAFELT or FIREMASTER ceramic fiber blanket with a one inch initial thickness and a 6-PCF initial density.

The joint may also include a plurality of spacers between an upper and lower half of the casing. The spacers insure that the fire seal is not compressed over time, insure the integrity of the seal, and obviate maintenance efforts. If no spacers are utilized, the seal may be compressed over time and bolts or other means to secure upper and lower halves of the casing may loosen.

The outer casing is preferably cylindrical in shape and advantageously includes support feet for supporting or stabilizing the casing in a fixed position.

The tank includes a tank fill pipe and the outer casing includes a fill hole in alignment with the tank fill pipe so as to enable easy filling of the tank. Preferably, the outer casing also includes two or more holes in the wall thereof through which extends a vent connected to the inner tank.

According to an advantageous feature of the invention, a specialized fire resistant spout assembly may be utilized as shown in FIG. 9. The spout assembly may be used for any openings in the upper half of the outer concrete casing, including an opening designed for filling, dispensing and venting the stored liquids. According to a further development of the invention, appropriate sealing materials may be utilized to enclose and secure the spout assembly pipes or risers. Up to seven separate openings ranging from 3 to 32 inches in diameter are contemplated for certain applications. Each opening requires appropriate sealant to secure a heat, air, and vaportight seal. The upper casing opening may utilize a complex conical configuration.

In a preferred embodiment, the outer casing is fabricated of pre-cast reinforced concrete. In an alternative embodiment, the casing is fabricated of pre-cast concrete which may utilize a lightweight aggregate or may contain a lightweight filler material such as vermiculite or solite so as to reduce the weight thereof.

Although the casing will normally act as an effective secondary containment, in an alternative embodiment a sealant is coated on the ribs and inner wall to assist in preventing leakage of liquid.

According to a further development of the invention, the vault may include a liquid level gauge which extends through an opening in the upper portion of the casing aligned with an opening in the tank. An upper pump outlet may also be provided, along with an emergency vent. Other aligned openings in the casing and tank may be provided as necessary. An additional feature of a tank according to the invention may include an airspace monitor with an indicator in order to monitor the conditions between the tank and the casing. The casing may be configured as two parts. These two parts may either be side-by-side or upper and lower. The respective halves may be fastened together by suitable means. According to an advantageous feature, they may be fastened by bolted clamps. Other fastening mechanisms, such as band clamps, may also be used.

Rubber gaskets may be provided surrounding the tank and aligned with the ribs. These may insulate the tank to protect the tank against galvanic action. Furthermore, gaskets may be advantageously positioned between the halves.

According to a preferred configuration, the vault may be placed on a concrete spill pad exhibiting raised boundaries and may be protected by one or more barrier posts.

Other features and advantages of the invention will be set forth in, or apparent from, the following detailed description of preferred embodiments of the invention.

BRIEF DESCRIPTION OF THE DRAWINGS

FIG. 5 is a perspective view, partially broken away and with parts omitted, of the outer casing of FIGS. 1 to 3, showing the support rib arrangement.

FIG. 6 shows a keying arrangement for a joint between two casing elements.

DESCRIPTION OF THE PREFERRED EMBODIMENTS

Figure 1:
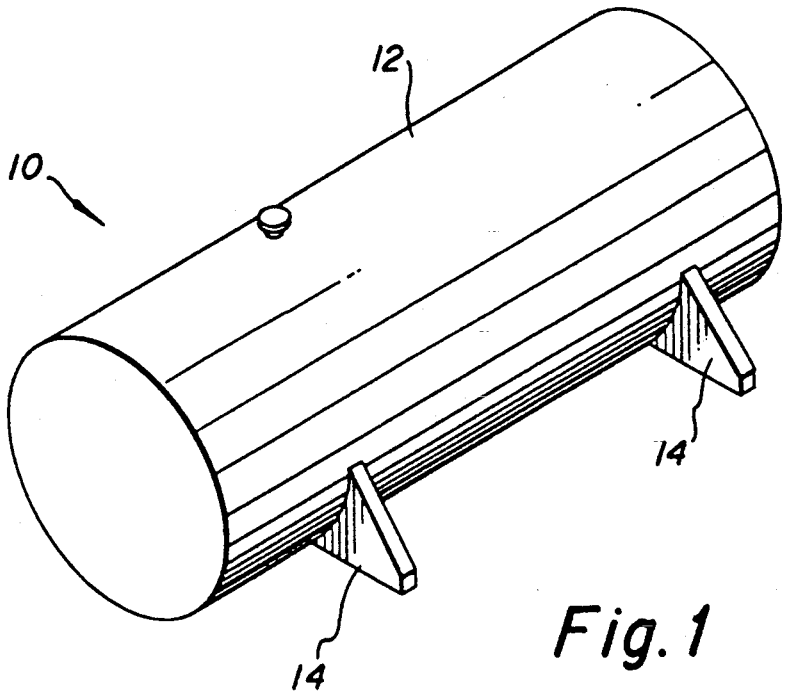
FIG. 1 is a perspective view of a liquid storage vault construction in accordance with a preferred embodiment of the invention.

Referring to FIG. 1, a perspective view of the storage vault of the invention is shown, illustrating the external appearance thereof. The vault, which is generally denoted 10, comprises an outer casing 12 which is generally cylindrical in shape and includes two sets of stabilizing legs of feet 14.

Figure 2:
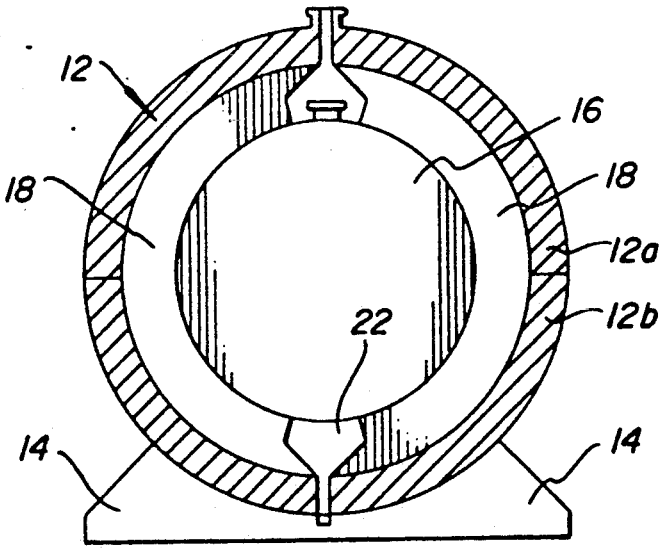
FIG. 2 is a transverse cross section through the vault construction of FIG. 1.
Figure 3:
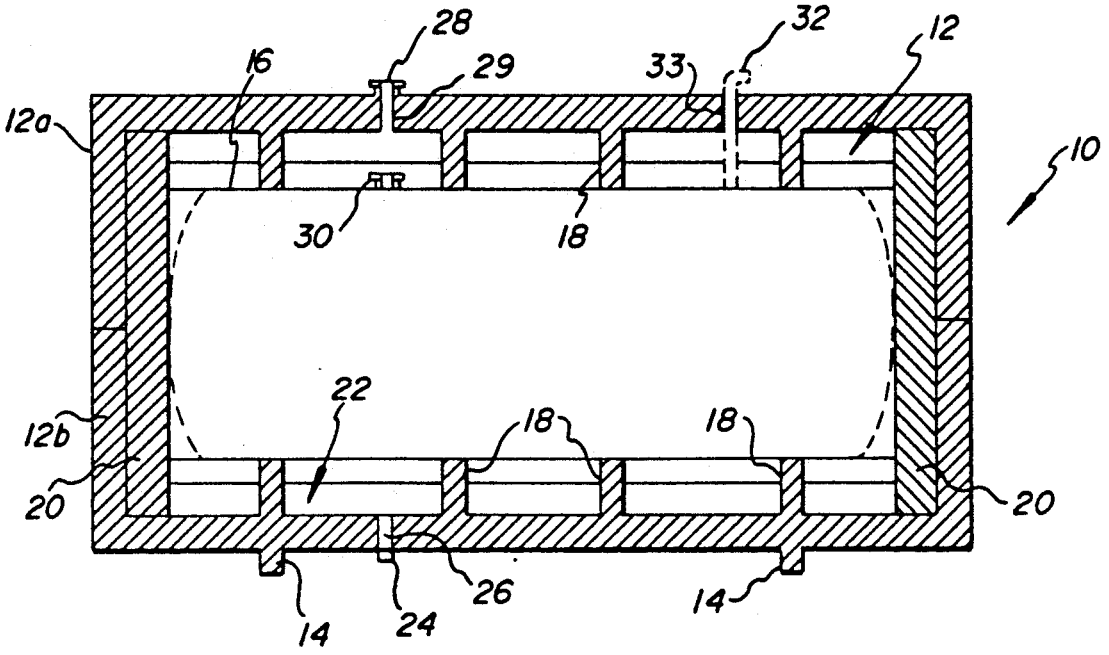
FIG. 3 is a longitudinal cross section through the vault construction of FIG. 1.

Referring to FIGS. 2 and 3, which are respectively, transverse and longitudinal cross sections of storage vault 10, an inner tank 16 is supported within outer casing 12 by a series of generally semi-annular ribs 18 which extend inwardly from both sides of the inner wall of casing 12. Tank 16 can be of conventional construction and preferably comprises a commercially available steel tank such as that made by other manufacturers. The opposed sets of ribs 18 may be separated from each other at the top and the bottom (FIG. 5). Alternatively, the ribs in the upper half may be continuous as shown in FIG. 2. The shapes of ribs 18 can be seen in FIG. 5, which is a perspective view of casing 10 that is partially broken away to shown ribs 18 and in which tank 16 is omitted for purposes of illustration.

The separation of, or discontinuity in, the ribs 18 at the bottom (to which reference was made above) results in a longitudinal channel 22 being defined or formed which permits liquid from a leaky tank 16 to collect in the bottom of outer casing 12. A sight plug 24 of clear hard plastic or the like may be located at the bottom of hole or opening 26 in the bottom of outer casing 12 or an end of the cylindrical outer casing at a point along the lowest level of the inner casing wall so as to provide a visual indication of whether or not liquid, such as from a spill or leak, has collected in channel 22 at the bottom of outer casing 12. It will be understood that plug 24 will appear darker when hole 26 is filled with liquid so that a ready visual indication of a leak or the like is provided. It will be appreciated that other visual indicators and even other types of leak indication (e.g., liquid sensors which activate an audible alarm) can also be employed, although sight plug 24 is generally preferred because of the effectiveness, ruggedness and simplicity thereof. A sight plug 24 may alternatively be located at an end of the concrete casing as shown in FIG. 1.

It will be appreciated that the air space created by ribs 18 between the outer wall of tank 16 and the inner wall of casing 12 can be designed to enable capture of all of the contents of tank 16 and, in a specific exemplary preferred embodiment, the space is 10% greater in volume than the volume of the tank 16 and thus capable of holding 100 more gallons where tank 16 is a thousand gallon tank. Further, this air space provides low-cost thermal protection for the inner tank 16.

The tank 16 further includes a fill spout 28, at the top thereof and extending through a hole 29 in the casing wall, which, in cooperation with a tank fill spout opening 30 enables filling of tank 16. A vent pipe 32 connected to tank 16 extends through a hole 33 in the wall of casing 12 at the top thereof so as to provide venting of tank 16.

Figure 9:
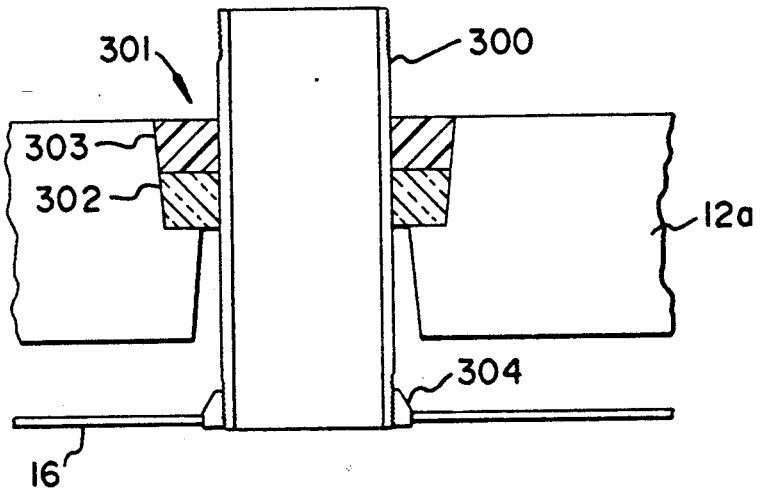
FIG. 9 shows a cross section of a passage assembly.

FIG. 9 depicts a cross section of a representative opening in the upper casing with a pipe/riser 300 penetrating through a seal 301. The upper section 12*a* of the casing includes an opening which is filled and sealed. The upper portion of the opening may exhibit a conically decreasing configuration, while the lower portion of the opening may exhibit a conically increasing configuration. A seal may advantageously be placed in the upper portion of the opening. The seal may be comprised of a first lower layer 302, made up of an insulating material. This insulating material is preferably a FIREMASTER thermal blanket. The upper layer 303 of the seal may be made up of a polyurethane material. According to a preferred embodiment, a pipe or riser 300 is threaded into an opening 304 in the steel tank. The riser passes through the opening in the concrete casing. The lower layer thermal ceramic blanket of the seal 302 is then put in place. A two component liquid polyurethane mixture may then be poured onto the lower layer of the seal. When the polyurethane cures, it forms the upper layer of the seal. Advantageously, each layer of the seal may be one and one-half inches thick. This seal acts as a weather barrier and is largely impervious moisture, vapor and air, and acts as a highly insulative fire barrier.

Casing 10 is preferably fabricated of concrete and, in an exemplary embodiment, the wall thereof is 6 inches thick. Although in a preferred embodiment, a casing of these dimensions and materials will contain, as a secondary containment, liquid leaking from tank 16, in an alternative embodiment, a non-permeable sealant is applied to the inner wall of casing 12 to prevent leakage through the casing.

Further, although casing 12 is simply made of concrete in accordance with a preferred embodiment, in an alternative embodiment, casing 12 may be made of concrete using a light weight aggregate or may include a very lightweight filler material such as vermiculite or solite (e.g., by impregnation of the precast concrete), so as to reduce the weight of the casing. It is estimated that the weight of the concrete casing can be reduced in this manner by about one-quarter to one-half while still exceeding fire code standards for the aboveground storage of flammable liquids, and thus can substantially reduce transportation and handling costs depending on the installation methods used.

Figure 4:
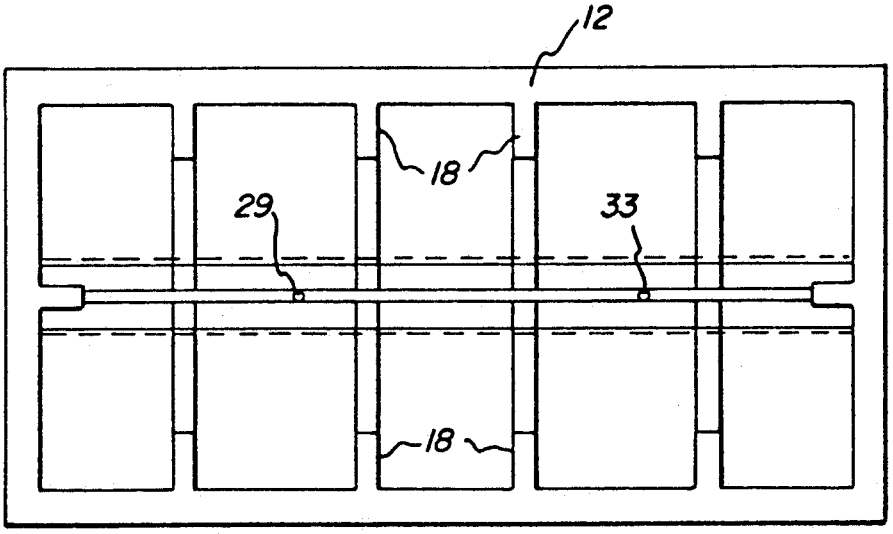
FIG. 4 is an inside plan view of the upper half of the outer casing of FIGS. 1 to 3.

As indicated in FIGS. 2 and 3, outer casing 12 is preferable of a two-piece construction with the two halves being denoted 12*a* and 12*b*. Referring to FIG. 4, an inside plan view of the upper half 12*a* is shown. The mating edges of the two sections can be provided with interlocking shapes 40 such as cooperating tongues and grooves so as to assist in providing a good seal between the two sections. FIG. 6 shows an exploded view of a keying arrangement for the vault casing. The upper casing element 101 is mated to a lower casing element 102. The upper casing element exhibits a keying configuration 103, which will fit a mating configuration 104 displayed on the lower casing element. Advantageously, a gasket 105 may be placed between the upper and lower elements for the purposes of stress relief and sealing.

Figure 7:
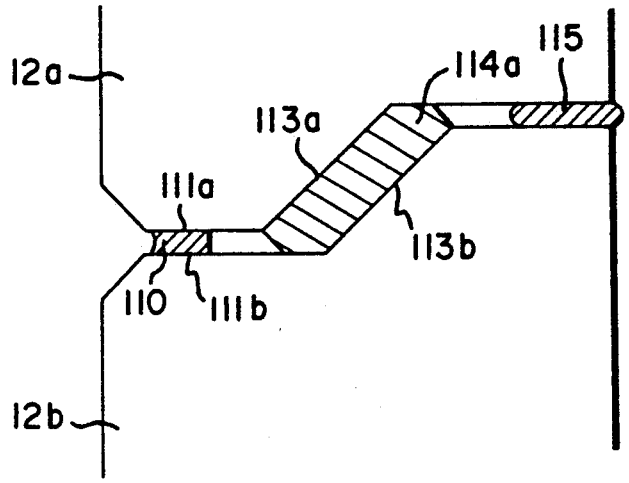
FIG. 7 shows a cross section of the wall assembly depicting the fire resistant vault joint.

FIG. 7 depicts a cross section of the wall assembly illustrating the fire and heat resistant vault joint. More specifically, the upper section 12*a* of the casing is attached to a lower section 12*b* by a multiple part seal. For illustration purposes, the curvature in the casing wall is not shown. Advantageously, the joint may be configured in a shiplap configuration with panel caulk 110 arrange in the area of first lands 111*a* and 111*b*. A refractory fiber intermediate seal is located in the area of an intermediate or second lands 113*a* and 113*b*. The second lands are at angles to the first lands. The third or inner lands 114*a* and 114*b* are located at angles to the immediate lands. An oil resistant sealant 115 is advantageously located in the area of the inner land 114. Taken together, these three lands provide for total secondary containment by the outer casing 12.

Figure 8:
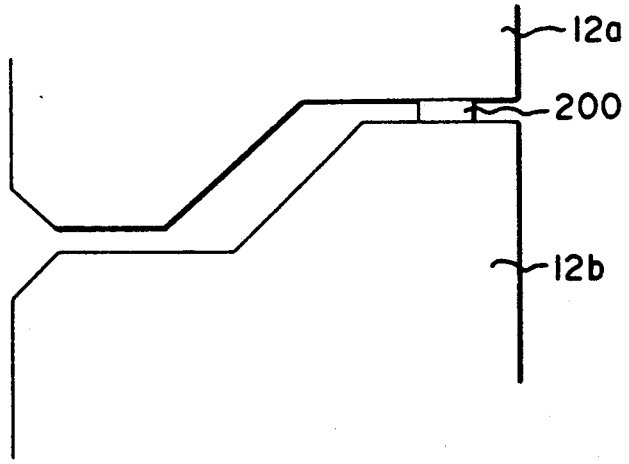
FIG. 8 shows a cross section of the wall assembly depicting a spacer.

The first or outer lands are configured for concrete to concrete contact (0" gap). In general, the maximum gap due to dimensional tolerance variations will not exceed 0.25 inches. The outer seal, in the area of the first lands may contain panel caulk. According to an advantageous embodiment, the inner lands or outer lands may be spaced to receive a spacer element 200 (FIG. 8) in order to maintain a gap between the upper and lower casing halves.

The intermediate seal, in the area of the second lands 113 is designed to be the primary fire stop point. Although the joint insulation point may generally have any suitable heat and fire resistant substance, in a preferred embodiment, the intermediate seal contains an aluminum-silicon ceramic material. This aluminum-silicon ceramic material will generally be about one inch thick and about two inches wide. Advantageously, this material may have a maximum temperature rate of at least 2300° F. Examples of such suitable fire resistant materials include CERAFELT® and FIREMAS- TER ®, available commercially from Morgan Thermal Ceramics Company.

The inner seal may contain any petroleum resistant concrete sealant. For example, a premium quality extruded non-hydrocarbon sealant designed specifically for fuel and oil resistant applications is suitable. The joint sealant generally fills a space of about 0.375 square inches. In a preferred embodiment, the joint sealant is CS-440 ®, available commercially from Concrete Sealants, Inc. Typically, the joint sealants must have excellent adhesion to concrete substances and be immersion resistant to a wide range of hazardous liquids including gasoline, diesel, jet A, JP-4, kerosene, motor oil and chemicals.

A fire performance evaluation of a test assembly constructed to be representative of the present invention was conducted. The test assembly consisted of the 6 inch thick concrete panels. The panels were assembled to form a wall section having a horizontal vault joint.

The test assembly representing the liquid storage apparatus of the present invention provided excellent protection against a high intensity fire exposure for a period of four hours.

Advantageously, a plurality of spacers 200 may be distributed between the upper and lower halves of the outer casing to prevent over compression of the heat and flame resistant sealing materials. The spacers may be distributed every 1 to 3 feet around the perimeter of the casing halves. The spacers may be made of a highly insulating (heat and fire resistant) material and may be non-deformable or only slightly deformable. According to one embodiment, the spacers may be metal washers or disk shaped elements. Alternatively, the lower casing may display a plurality of protrusions formed out of concrete in order to act as spacers. Advantageously, the spacers display a configuration mating the two casing halves. Furthermore, the spacers may engage detents in one of the casing halves.

It will be appreciated that precasting of casing 12 in two sections 12*a* and 12*b* for final assembly at the site location provides a number of advantages with respect to ease of shipment and handling. However, in most cases, the vault will be constructed prior to being shipped to a site for installation. This can enhance the quality of fabrication.

Although the present invention has been described relative to specific exemplary embodiments thereof, it will be understood to those skilled in the art that variations and modifications can be effected in these exemplary embodiments without departing from the scope and spirit of the invention.

What is claimed is:

1. A vault construction for the storage of hazardous or polluting liquids, said vault construction comprising:

an inner cylindrical steel tank for storing liquids and including an outer tank wall;

a multiple part concrete outer casing in which said inner cylindrical tank is housed and including an inner surface, said outer casing exhibiting a plurality of ribs extending inwardly from the inner surface of the casing defining a plurality of spaces between the inner wall of the casing and the outer tank wall;

a highly fire resistant sealed joint between adjacent parts of said outer casing;

a plurality of spacers located in said joint between adjacent parts of said outer casing.

2. A vault construction according to claim 1, wherein said outer casing comprises upper and lower halves which fit together to form said casing.

3. A vault according to claim 1 wherein said sealed joint is a multiple seal joint.

4. A vault construction according to claim 3 wherein said multiple seal joint comprises:

a caulk outer seal;

a refractory fiber intermediate seal; and a petroleum resistant concrete inner seal.

5. A vault construction according to claim 4, wherein said joint is a shiplap joint insulation point.

6. A vault construction according to claim 5 wherein said outer seal is located at an outer land of said joint, said intermediate seal is located at an intermediate land of said joint and oriented at a first angle to said outer lands and said inner seal is located at an inner land of said joint and oriented at an angle to said intermediate land.

7. A joint construction according to claim 6, wherein said refractory fiber exhibits refractory oxides bonded with an organic binder.

8. A vault construction according to claim 6, wherein said refractory fiber is an aluminum silicon ceramic material.

9. A vault construction according to claim 8, wherein said inner seal is an extruded non-hydrocarbon sealant.

10. A vault construction according to claim 1, wherein said non-hydrocarbon sealant is CS-440.

11. A vault construction according to claim 1, wherein said outer casing is cylindrical in shape and includes support feet for stabilizing the casing in position.

12. A vault construction according to claim 1, wherein said tank includes a tank fill pipe and said outer casing includes a fill hole in alignment with said tank fill pipe for enabling filling of the tank.

13. A vault construction according to claim 1, wherein said outer casing includes a hole in the wall thereof through which extends a vent connected to said inner tank.

14. A vault construction according to claim 1, wherein said casing is fabricated of pre-cast reinforced concrete containing a lightweight filler material.

15. A vault construction according to claim 1, wherein said casing includes a sealant coated on an inner surface of said ribs.

16. A vault construction according to claim 1, wherein said ribs are configured to engage portions of said outer tank wall.

17. A vault construction according to claim 1, wherein said ribs are radially extending circumferential ribs disposed on an inner surface of said casing.

18. A vault construction according to claim 1, wherein said ribs are discontinuous at a bottom of said casing, thereby defining a liquid collection channel.

19. A vault construction according to claim 11, wherein a lower portion of said outer casing defines a spill channel.

20. A vault construction according to claim 1, wherein said spacers comprise a highly fire resistant material.

21. A vault construction according to claim 1, wherein said spacers comprise a substantially non-deformable material.

22. A vault construction according to claim 1, wherein at least one part of said outer casing exhibits a contour matching a contour of said spacers and setting alignment of said spacers.

23. A vault construction according to claim 1, wherein said outer casing is fabricated of pre-cast reinforced concrete utilizing a light weight aggregate.

24. A vault construction according to claim 1, further comprising an insulating gasket disposed on said ribs between said outer casing and said inner tank.

25. A vault construction according to claim 1, further comprising a passage connected to said steel tank and extending through said outer casing.

26. A vault construction according to claim 25, wherein said passage is a threaded pipe and further comprises at least a seal between said tube and said outer casing.

27. A vault construction according to claim 26, wherein said seal comprises an insulating layer and a barrier layer.

28. A vault construction according to claim 27, wherein said insulating layer is a thermal ceramic blanket and said barrier layer is polyurethane.

* * * * *